US010450816B2

(12) United States Patent
Bringham

(10) Patent No.: US 10,450,816 B2
(45) Date of Patent: Oct. 22, 2019

(54) BYPASS STYLE HYDRAULIC SET AND QUARTER TURN TUBING ANCHORS

(71) Applicant: D&L Manufacturing, Inc., Tulsa, OK (US)

(72) Inventor: Heath Bringham, Sand Springs, OK (US)

(73) Assignee: D&L Manufacturing, Inc., Tulsa, OK (US)

( * ) Notice: Subject to any disclaimer, the term of this patent is extended or adjusted under 35 U.S.C. 154(b) by 0 days.

(21) Appl. No.: 16/004,632

(22) Filed: Jun. 11, 2018

(65) Prior Publication Data

US 2018/0355689 A1 Dec. 13, 2018

Related U.S. Application Data

(60) Provisional application No. 62/517,695, filed on Jun. 9, 2017.

(51) Int. Cl.
*E21B 23/01* (2006.01)

(52) U.S. Cl.
CPC ..... *E21B 23/01* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,434,438 | A * | 3/1969 | Hart | D05B 23/009 112/122 |
| 3,749,167 | A * | 7/1973 | Young | E21B 23/06 166/134 |
| 5,441,111 | A * | 8/1995 | Whiteford | E21B 33/1293 166/123 |
| 7,255,172 | B2 | 8/2007 | Johnson | |
| 9,157,289 | B1 | 10/2015 | Bair et al. | |
| 2014/0216722 | A1 * | 8/2014 | Badrak | E21B 33/129 166/206 |
| 2014/0305633 | A1 | 10/2014 | Bracken | |

* cited by examiner

*Primary Examiner* — David J Bagnell
*Assistant Examiner* — Ronald R Runyan
(74) *Attorney, Agent, or Firm* — Gabe Gotwals

(57) ABSTRACT

Embodiments of a tubing anchor catcher includes a setting and a stationary sleeve each containing a set of spaced-apart cone pieces at one end that form a cone block configured to engage a set of slips. The anchor catcher, which may be designed for hydraulic or rotational setting, provides a reduced outside diameter that allows room for gas or debris bypass as well as capillary or electrical lines to be banded along the outside of the tool while providing a full open inside diameter. Because there is area available between the slips, multiple lines may be banded to the tool. In some embodiments, one of the raised slip protectors may include a line carrier sized to receive a capillary or electrical line.

28 Claims, 10 Drawing Sheets

BYPASS STYLE HYDRAULIC SET AND QUARTER TURN TUBING ANCHORS

CROSS-REFERENCE TO CO-PENDING APPLICATIONS

This application claims priority to U.S. 62/517,695 for Bypass Style Hydraulic Set and Quarter Turn Tubing Anchors filed Jun. 9, 2017, the contents of which are hereby incorporated by reference.

BACKGROUND

This disclosure relates to downhole tools and, more particularly, to tubing anchors and catchers like those used in oil and gas downhole applications.

Downhole applications involving chemical treatment or well monitoring are becoming more popular as the benefits of treatment and monitoring become more well known. Traditionally, the capillary (chemical injection) or electrical monitoring lines used in these applications are banded to the tubing and terminated above a downhole tubing anchor in the wellbore. Because this anchor requires a number of rotations to set it, its use was limited and, when used, the lines risked damage.

New technologies have made it possible to bypass the anchor and position the chemical treatment or well monitoring equipment right at the pump intake. This arrangement increases the efficiency of the treatment, provides more accurate data and, because it often uses a quarter-turn design, makes it much safer to deploy without risking damage to the capillary lines.

One popular quarter-turn design is a downhole capillary injection anchor ("tool") that can accept a single ¼" or ⅜" capillary line through a passageway located inside the tool's outer components. See e.g., US 2014/0305633 & Table 1 below. The 5½" tool has a full open 2⅞" tubing, 2.441" inside diameter ("ID") that allows an operator to use it with standard 2¼" rod pumps. However, the tool is limited to a single capillary line.

Other designs make use of a reduced outside diameter ("OD") that allows room for the capillary or electrical lines to be banded along the outside of the tool. See e.g., U.S. Pat. No. 7,255,172 & 9,157,289). However, the reduced OD is usually accompanied by a similar ID reduction. Normally, 5½" tools with reduced ODs are built on 2⅜" mandrels with 2" or smaller IDs. While these tools allow room for two or three capillary or electrical lines to be banded along the outside of the tool, the ID restriction requires the use of a smaller pump and, therefore, lower production rates. The ID restriction can result from the use of a one-piece cylindrical cone that threads onto a portion of the anchor and engages the slips (usually four in number). For the cone to properly perform its function, the cone typically has a larger outside diameter than the pusher sleeve and is normally threaded onto the anchor.

TABLE 1

Bypass Style (Prior Art) Anchor Designs.

| | Weatherford Capillary Injection Anchor | Various Quarter Turn Capillary Anchors | TechTAC Slimline Anchor | Black Gold Hydraulic Anchor |
|---|---|---|---|---|
| Anchor Type | Anchor Only | Anchor/ Catcher | Anchor/ Catcher | Anchor Only |

TABLE 1-continued

Bypass Style (Prior Art) Anchor Designs.

| | Weatherford Capillary Injection Anchor | Various Quarter Turn Capillary Anchors | TechTAC Slimline Anchor | Black Gold Hydraulic Anchor |
|---|---|---|---|---|
| Setting Mechanism | Jay | Jay | Rotation | Hydrostatic |
| Rotation to Set | ¼ Turn | ¼ Turn | 7-8 Turns* | None |
| Tool Maximum OD | 4.500" | 4.500" | 4.500" | 4.784" |
| Tool Reduced OD | N/A | N/A | 3.750" | 4.000" |
| Tool ID | 2.441" | 2.441" | 1.995" | 2.441" |
| Capillary Size | ¼"-⅜" | ¼"-⅜" | ¼"-⅜" | ¼" |
| Capillary Capacity | 1 | 1 | 3 | 2 |
| Capillary Location | Through Tool | Through Tool | External | External |
| Gas Bypass | No | No | Yes | Yes |

*Unsuitable in practice for running capillary lines because of the number or rotations to set.

A need exists for a reduced OD anchor that reduces or eliminates the rotation required to set the tool, maintains the full 2⅞" tubing ID, can be used as an anchor/catcher, and can accept more (e.g. >3) and larger capillary lines than had previously been possible (e.g. a ⅝" line).

SUMMARY

Embodiments of a retrievable tubing or cap string tool or anchor catcher ("anchor") that may be hydraulically or rotationally set provide a reduced outside diameter that allows room for gas bypass as well as capillary or electrical lines to be banded along the outside of the tool. The anchor may include heat-treated steel alloy double-acting slips for effective holding power in tension (as an anchor) or compression (as a catcher). The fully enclosed slips allow for maximum bypass area around the outside of the anchor while maintaining a full open inside diameter through the tubing. In embodiments, the anchor body is no larger than the tubing couplings that run up to the surface of the well.

The anchor may be used to route multiple capillary lines or monitoring cables past the anchor and provide a gas/debris bypass area around the slips. In some embodiments, the anchor incorporates three heat-treated steel alloy slips that provide effective holding in both tension and compression and use component spacing to allow increased annular flow and capillary tube bypassing. This allows operators to increase space for gas while running capillary lines without compromising tubing size in, for example, a 5½×2⅞-in. configuration. The anchors also serve as catchers, meaning that they do not require upward tension to remain in place. Embodiments provide capability of running multiple capillary and data lines while allowing increased gas production because of the multiplied space for gas to travel upward toward the wellhead.

The embodiments may include two sleeves—one setting, the other stationary—that include at their ends spaced-apart cone pieces that form a cone block that actuates a set of slips. The sleeves may include a pocket to receive a complementary shaped portion of the cone piece. In some embodiments, the pocket includes grooves and the cone piece includes teeth sized to fit the grooves. The cone piece may include retaining means such as feet that extend laterally outward and help retain the piece within the slip cage. A lower (load pad) surface of the cone piece may match the external profile of the mandrel.

In some embodiments, the anchor includes a pusher sleeve arranged for axial movement towards and away from the slip cage and a stationary sleeve, with each of the sleeves housing a respective portion of an inner mandrel and including a slip-cage end that contains two or more spaced-apart, cone-receiving pockets. Each cone-receiving pocket includes a cone piece that, together with the other cone pieces, forms a cone block to actuate a set of slips. A slip cage located between the pusher sleeve and the stationary sleeve receives the slip-cage ends of the pusher sleeve and the stationary sleeve. The slip cage houses another portion of the inner mandrel and includes spaced-apart thru-slots. Each thru-slot has a raised slip protector at each end. The thru-slots receive a slip loaded from the interior of the slip cage as well as the cone piece.

Because there is area available between all of the slips, a bypass is provided for gas, debris, or lines. Multiple lines may be banded to the tool with no added modifications. In some embodiments, one of the raised slip protectors may be a line carrier that includes an arcuate-shaped slot that runs its entire length, with teeth located on each side of the slot.

BRIEF DESCRIPTION OF THE DRAWINGS

FIG. 5 is an end view of the anchor during run in.

FIG. 12 is an end view of the anchor during run in.

ELEMENT NUMBERS AND ELEMENTS USED IN THE DRAWINGS AND DETAILED DESCRIPTION

Figure 1:
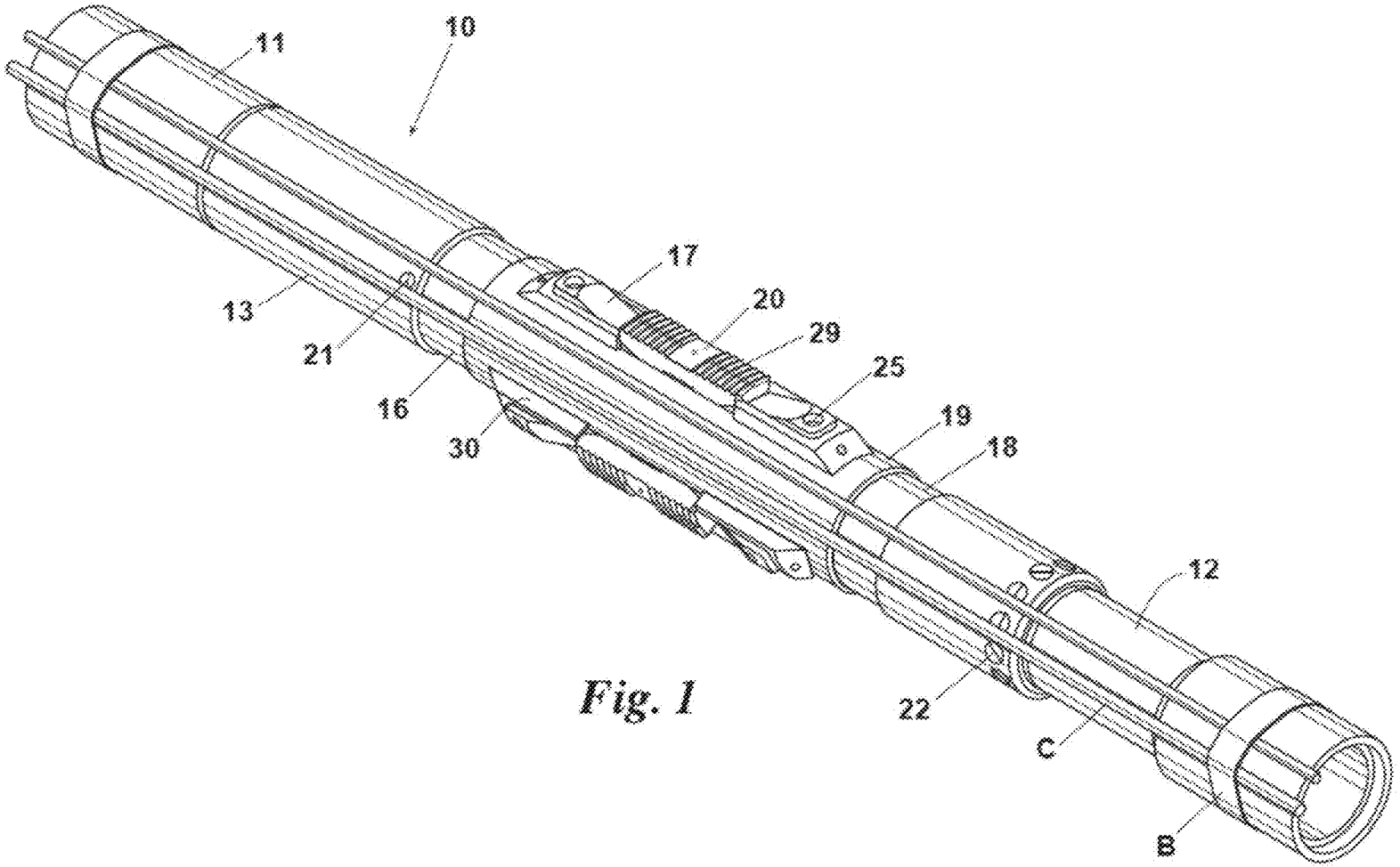
FIG. 1 is an isometric view of an embodiment of an hydraulic set tubing anchor catcher of this disclosure including capillary or electrical monitoring lines running along the outside of the anchor.
Figure 2:
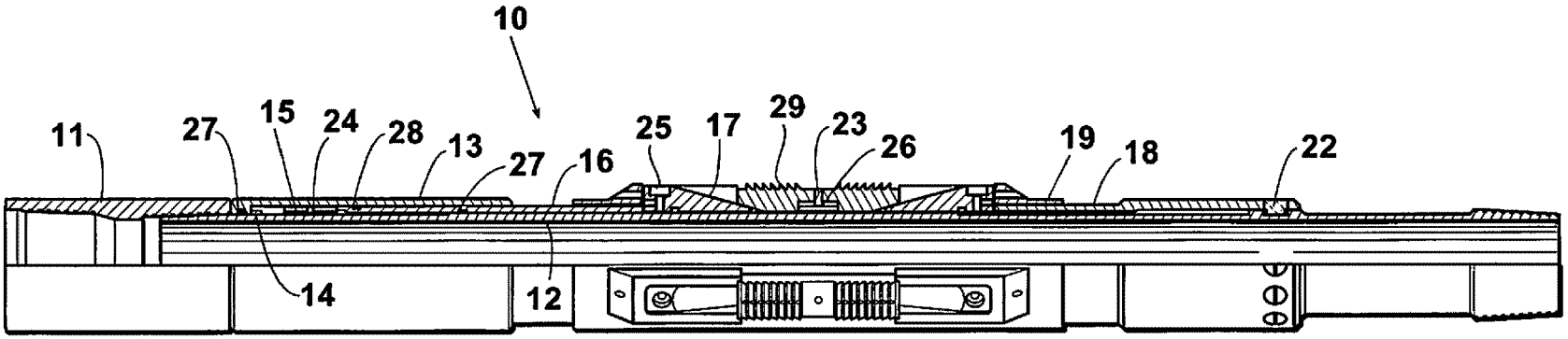
FIG. 2 is a front elevation view of an embodiment of an hydraulic set tubing anchor of this disclosure.
Figure 3:
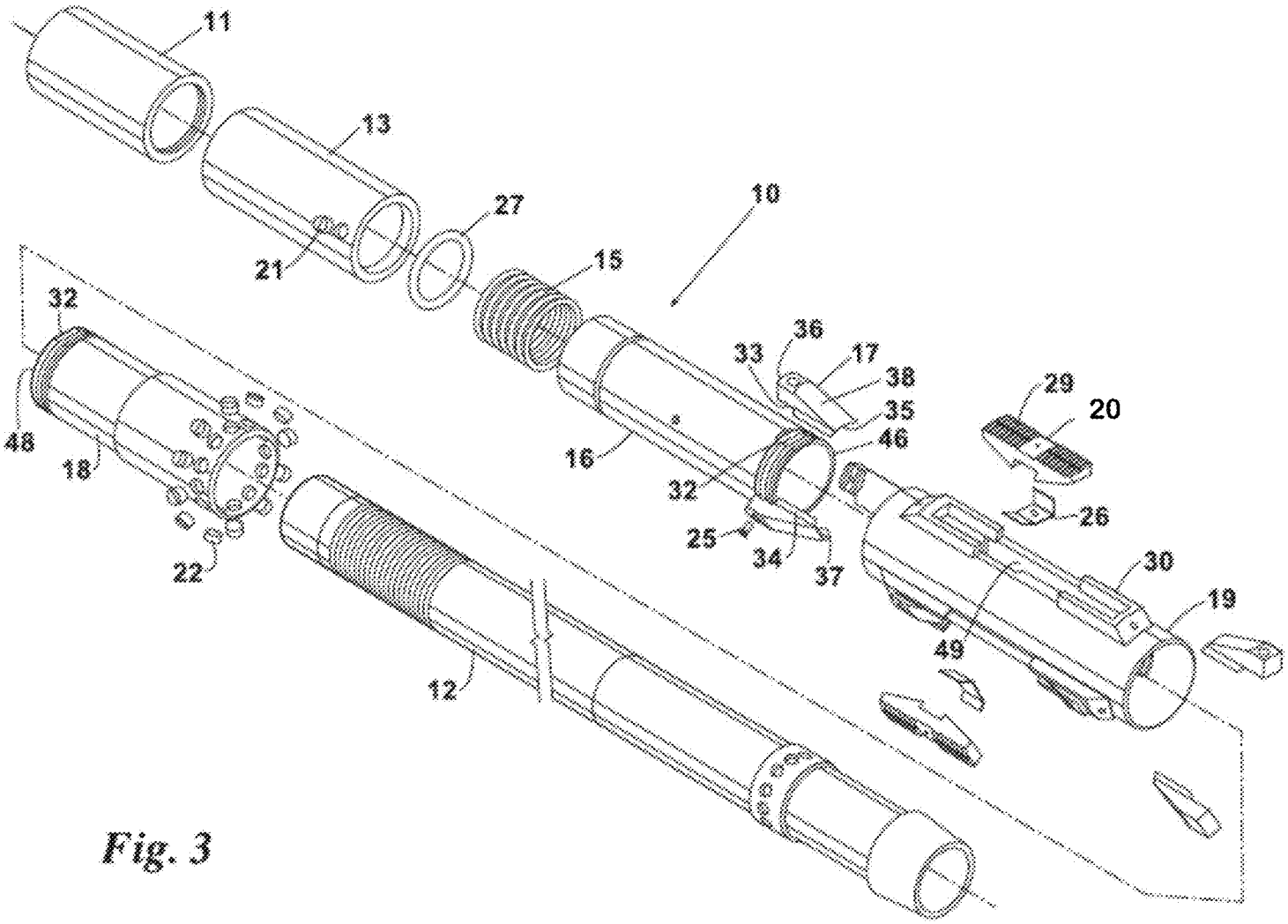
FIG. 3 is an exploded view of the anchor of FIG. 1.
Figure 4:
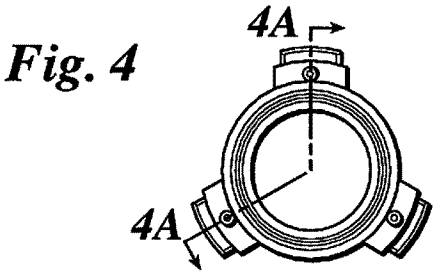
FIG. 4 is an end view of the anchor during slip installation
Figure 4A:
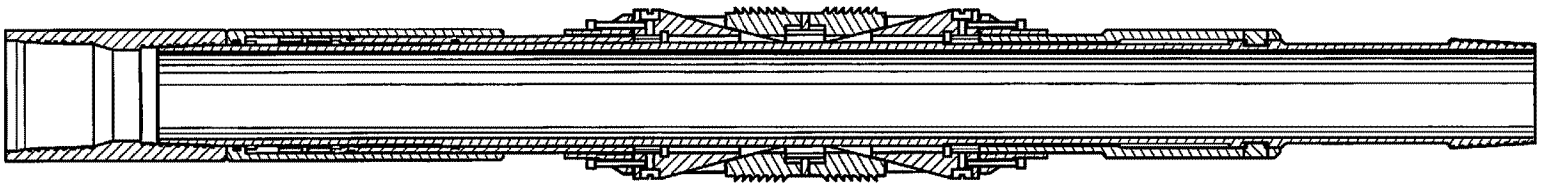
FIG. 4A is a view taken along section line 4A-4A of FIG. 4.
Figure 5:
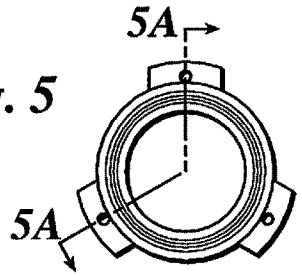
Figure 5A:
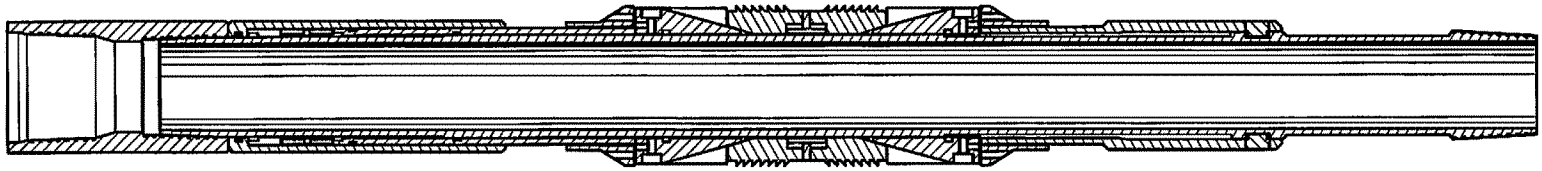
FIG. 5A is a view taken along section line 5A-5A of FIG. 5.
Figure 6:
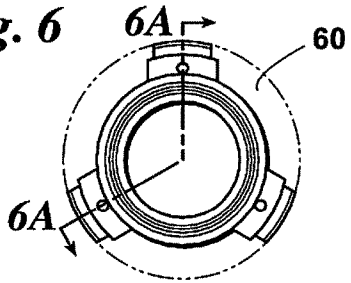
FIG. 6 an end view of the anchor in a maximum set position.
Figure 6A:
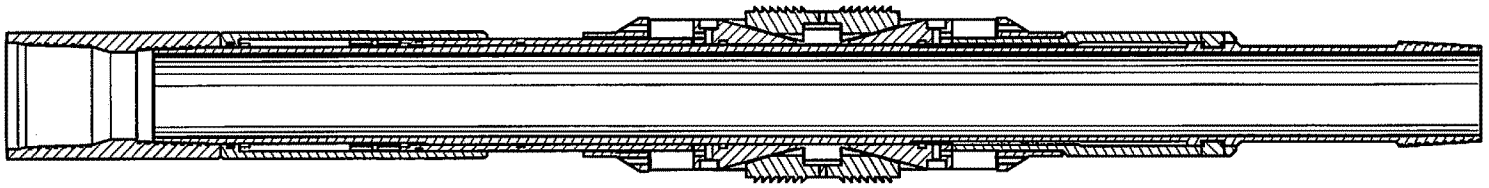
FIG. 6A is a view taken along section line 6A-6A of FIG. 6.
Figure 7:
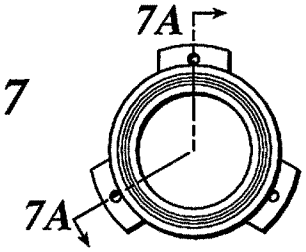
FIG. 7 an end view of the anchor during shear release.
Figure 7A:
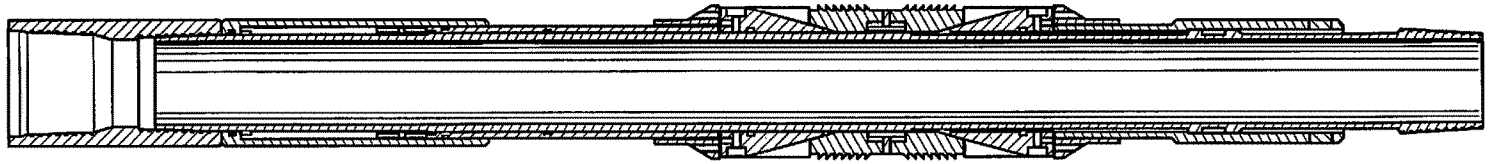
FIG. 7A is a view taken along section 7A-7A of FIG. 7.
Figure 8A:
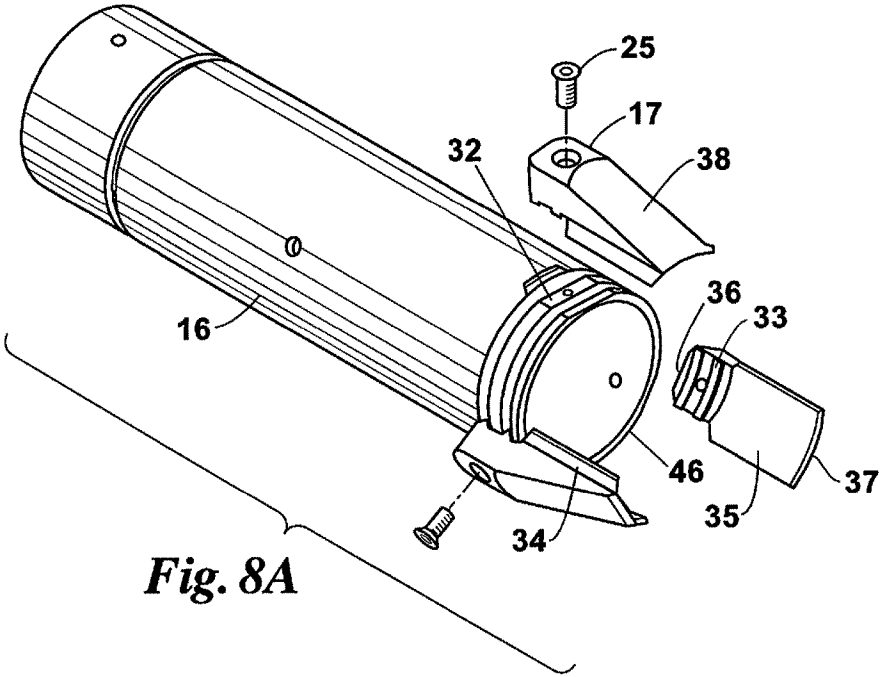
FIG. 8A is an exploded view of cone assembly.
Figure 9:
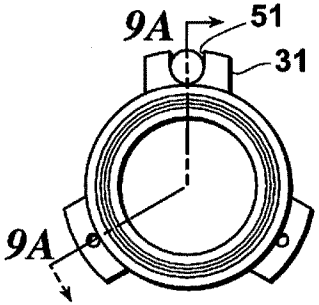
FIG. 9 is an end view of an embodiment of an hydraulic set tubing anchor catcher of this disclosure that includes a raised slip protector with an arcuate-shaped slot that runs its entire length, with teeth located on each side of the slot.
Figure 9A:
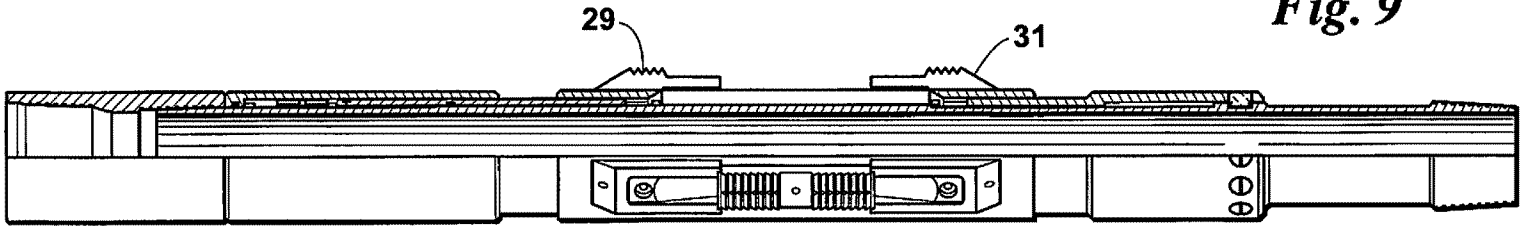
FIG. 9A is a view taken along section line 9A-9A of FIG. 9.
Figures 8B, 10:
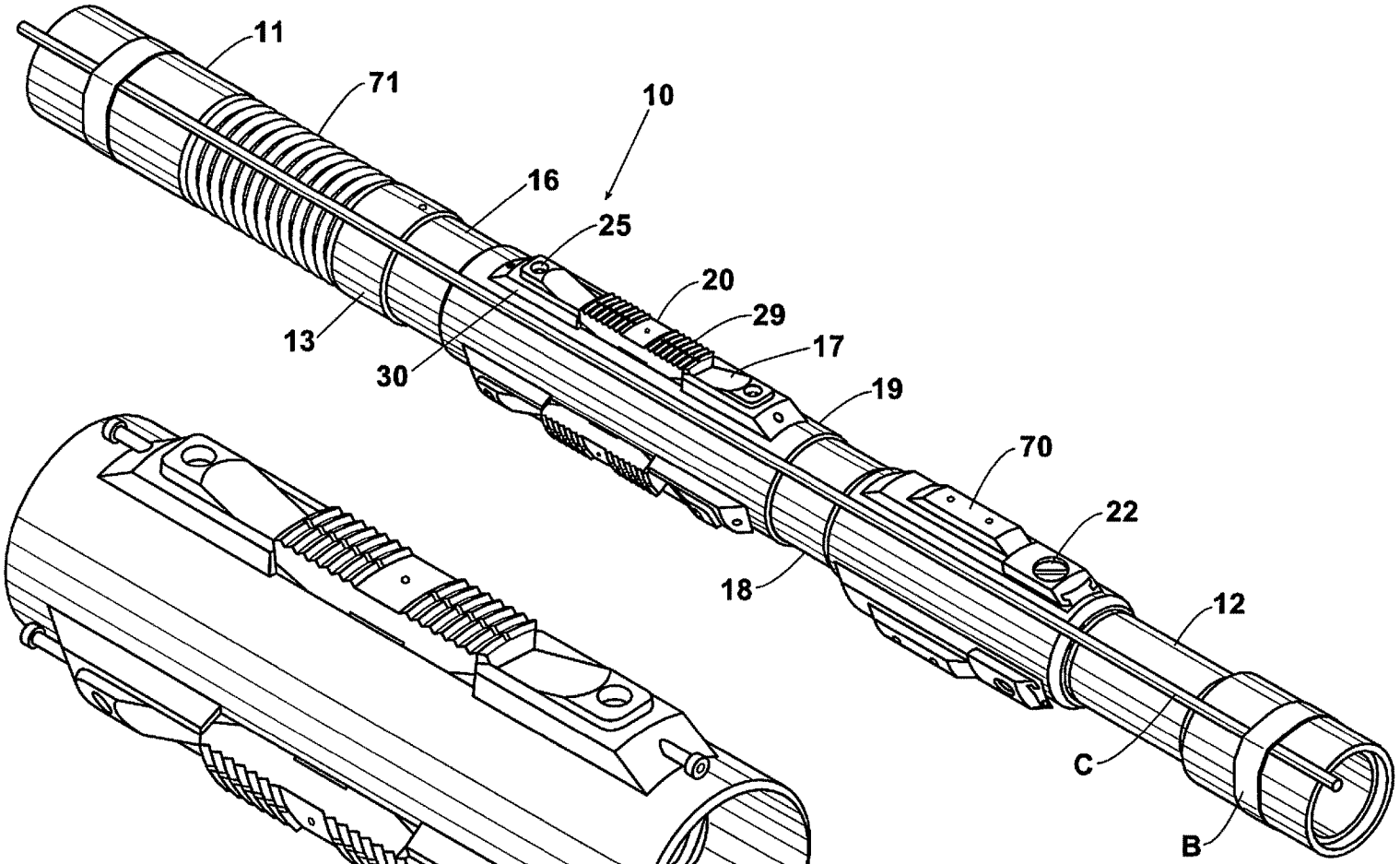
FIG. 8B is an isometric view of slip installation.
FIG. 10 is an isometric view of an embodiment of a reduced outside diameter quarter-turn tubing anchor of this disclosure including capillary or electrical monitoring lines running along the outside of the anchor.

10 Anchor catcher
11 Top sub
12 Inner mandrel
13 Setting chamber
14 Stop ring
15 Lock nut
16 Setting sleeve (e.g. piston or pusher sleeve)
17 Cone piece (that forms part of a cone block)
18 Support sleeve or stationary sleeve
19 Slip cage
20 Slip
21 Shear screw
22 Shear screw
23 Cap screw
24 Shear screw
25 Cap screw
26 Slip spring
27 O-ring
28 O-ring
29 Teeth
30 Slip protectors
31 Carrier
32 Pocket for cone piece
33 Tooth
34 Foot or base
36 Load pad
36 First end or slip cage end
37 Second end
38 Inclined surface
46 End of 16
48 End of 18
49 Thru-slot or slip window
51 Semi-circular portion
60 External bypass channel (for gas, debris, capillary lines)
70 Drag block
71 Spring
89 Tool full inside diameter ("ID")
91 Tool reduced outside diameter ("OD")
93 Tool maximum OD when in unset position
95 Tool maximum OD when in set position

DETAILED DESCRIPTION

For the purposes of this disclosure, "embodiment" means an example or an arrangement of a bypass style, reduced outside diameter ("OD") tubing or cap string tool or anchor catcher. Because embodiments of the tool of this disclosure serve as an anchor and as a catcher, meaning that the tool does not require upward tension to remain in place, the terms tubing anchor and tubing anchor catcher may be used interchangeably in this detailed description when referring to the tool of this disclosure.

Embodiments of a retrievable, reduced outside diameter tubing anchor catcher of this disclosure include hydraulically-set retrievable anchors and rotationally set anchors designed to hold the tubing string in tension or compression (or tension and compression but not at the same time). The anchor is suited for treating, testing, injecting, pumping wells, and flowing wells, deep or shallow. The slip design allows the anchor to be left in tension or compression, depending on well conditions and the required application. The anchor, which also serves as a catcher, prevents movement of the tubing during pumping strokes and holds it stationary if it should part.

Embodiments may use heat-treated steel alloy double-acting slips for maximum holding power in tension or compression. The fully enclosed slips allow for maximum bypass area around the outside of the anchor while maintaining a full open inside diameter ("ID") through the tubing. Embodiments can be used to route multiple capillary lines or monitoring cables past the anchor and to provide a gas/debris bypass area around the slips. The use of a tubing anchor of this disclosure increases pump efficiency, reduces rod and tubing wear, and keeps tubing and rods from falling into the well in case of a part.

Hydraulic embodiments of the tubing anchor may be operated by applying pressure to the tubing. This pressure shears screws that hold the anchor unset. A setting piston drives the slips set while locking the setting force in place. The hydraulic tubing anchor may be retrieved by shearing screws with tension. Shear pins may be added in predetermined increments (e.g., 5,000 lb increments) to achieve the desired shear value necessary to release. In rotational embodiments, a J-slot ("Jay") design may be used for easy setting and releasing with quarter-turn right-hand set, right-hand release. In embodiments, the set and release forces may be adjusted. During setting and releasing, a setting mechanism, which may be in the form of a sleeve, moves axially toward a slip cage between a run-in or unset position and a set position. The amount of axial travel is effective for fully engaging the slips in the set position and fully releasing the slips in the unset position.

Figure 12:
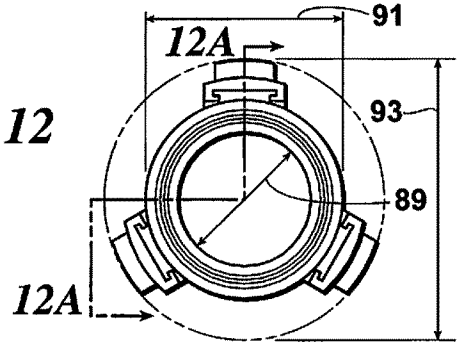
Figure 11:
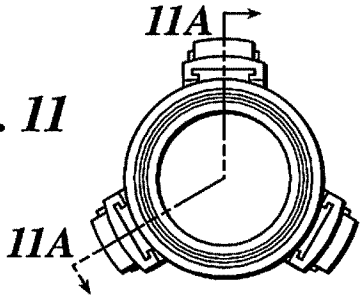
FIG. 11 is an end view of the anchor during slip installation
Figure 12A:
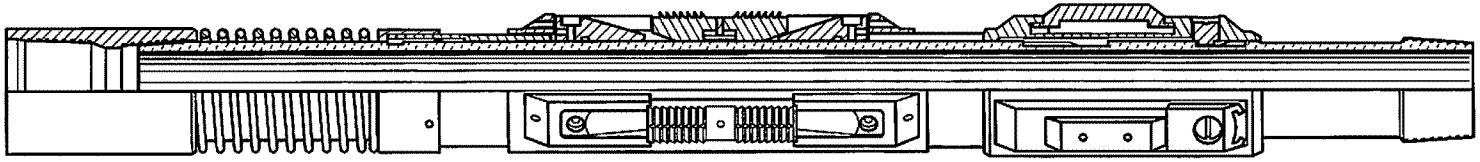
FIG. 12A is a view taken along section line 12A-12A of FIG. 12.
Figure 11A:
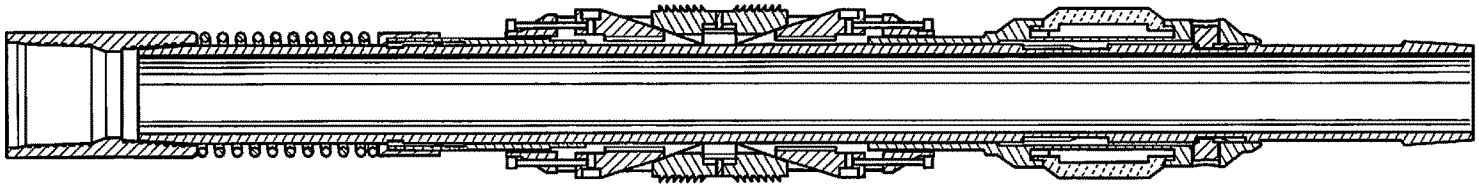
FIG. 11A is a view taken along section line 11A-11A of FIG. 11.
Figure 13:
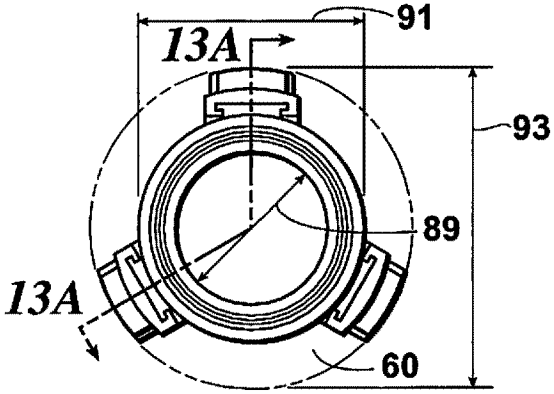
FIG. 13 an end view of the anchor in a maximum tension set position.
Figure 13A:
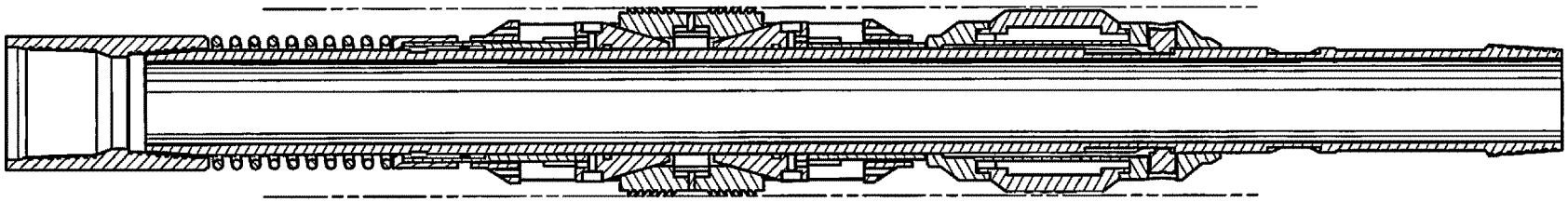
FIG. 13A is a view taken along section line 13A-13A of FIG. 13.
Figure 14:
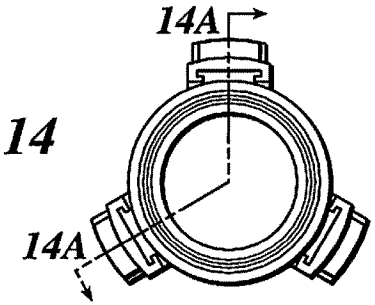
FIG. 14 is an end view of the anchor in a maximum compression set position.
Figure 14A:
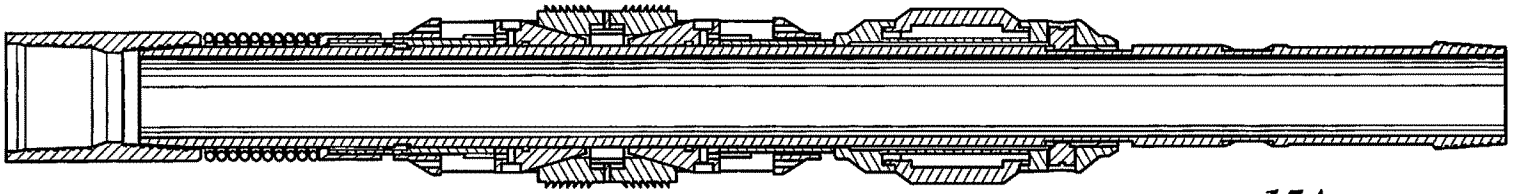
FIG. 14A is a view taken along section line 14A-14A of FIG. 14.
Figure 15:
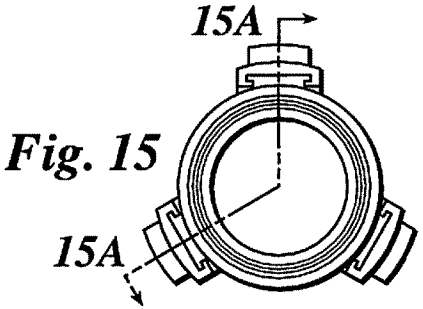
FIG. 15 an end view of the anchor during shear release.
Figure 15A:
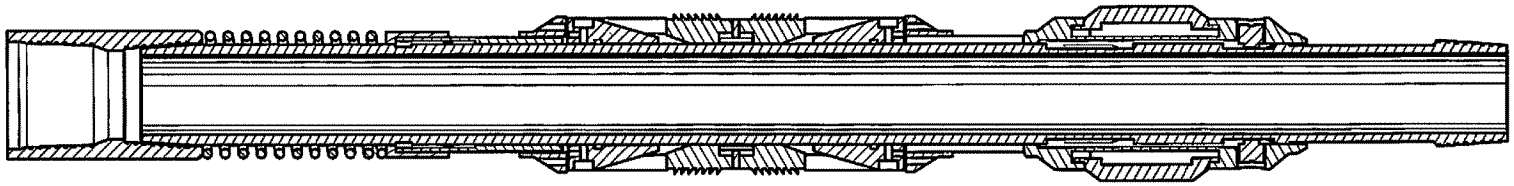
FIG. 15A is a view taken along section 15A-15A of FIG. 15.

Referring to FIGS. 1 to 9A, embodiments of a bypass style, reduced outside diameter ("OD") tubing or cap string tool or anchor catcher 10 makes use of a hydraulic set design that eliminates the need for rotation and provides a platform for a thin cross-section setting mechanism. In embodiments, the ID of the sleeve 16, 18 accommodates the OD of the mandrel 12 (in tight tolerance relationship) with the OD of the sleeve 16, 18 being the same or about the same as an OD of a tubing coupling used in the string (e.g. the OD of a 2⅞" tubing coupling). See e.g. FIG. 12 at element 89).

In some embodiments, the anchor 10 employs a triple- or tri-lobe bypass design that provides three external bypass channels 60. The channels 60 may provide gas or debris bypass as well as room for capillary lines C that may be connected by bands B to the anchor 10. The lobes, which may be defined by slips 20 or slip protectors 30, may be evenly spaced-apart about the slip cage at 120° intervals or another predetermined spacing interval (e.g. 4 lobes at 90° intervals). The minimum bypass channel 60 is defined by the tool reduced OD 91 and the maximum OD 93 when in the unset position. The maximum bypass channel 60 is defined by the tool reduced OD 91 and the maximum OD 95 when in the set position. (For the purposes of this disclosure, the tool reduced OD is the OD of the body or housing not including the lobes). The ID 89 provides a full ID, for example, a full open 2⅞" tubing, 2.441" ID that allows an operator to use the anchor 10 with standard 2¼" rod pumps while at the same time accommodating multiple capillary lines C.

As shown in FIGS. 10 to 15A, in other embodiments of the anchor catcher 10 the hydraulic set design is replaced by a quarter-turn design, thereby keeping rotation to a minimum. The quarter-turn design may also employ a triple- or tri-lobe bypass design. Tables 2 and 3 summarize various features of some embodiments.

TABLE 2

Features of Various Anchor Embodiments.

| | Hydraulic Set Anchor | Quarter Turn Anchor |
|---|---|---|
| Anchor Type | Anchor/Catcher | Anchor/Catcher |
| Setting Mechanism | Hydraulic | Jay |
| Rotation Required to Set | None | Quarter turn |
| Tool Maximum OD | 4.500" | 4.500" |
| Tool Reduced OD | 3.668" | 3.668" |
| Tool ID | 2.441" | 2.441" |
| Capillary Size | ¼-⅜" | ¼-⅜" |
| Capillary Capacity | 9+ | 3 |
| Capillary Location | External | External |

TABLE 3

Specifications of Some Embodiments.

| | Casing | | Hole | Max | Reduced | Tool |
|---|---|---|---|---|---|---|
| Setting Mechanism | Size (inches) | Weight (lbs/ft) | Size (inches) | OD (inches) | OD (inches) | ID (inches) |
| Hydraulic & Quarter Turn | 5½ | 14-23 | 4.670-5.040 | 4.50 | 3.67 | 2.44 |
| Hydraulic | 7 | 17-32 | 6.094-6.538 | 5.75 | 4.50 | 3.00 |

In the hydraulic set design, a conventional locking ratchet ring 14 may be used inside the hydraulic setting mechanism 13 to lock the setting forces and allow the anchor 10 to also serve as a tubing catcher. While a conventional hydraulic set-and-release mechanism may be used to actuate the anchor 10, a novel slip-and-cone design is included. The same is true if a conventional quarter-turn design is used: the setting mechanism is conventional, the slip-and-cone design is novel. The quarter-turn design may also include features known in the art, such as a drag block 70 and spring 71. However, by sectioning the cone into removable pieces 17A-17C to form a cone block, see e.g. FIGS. 3 & 8A, as is done with the slips 20, the setting mechanism 13 is able to fit inside the restriction while still providing full support to the slips 20 along the entire range of axial travel between the unset (run-in) and set position.

The raised slip protectors 20 around the anchor 10 house the slips 20 and cone pieces 17 and may form the lobes. The sleeve 16, which transfer setting loads to the cone pieces 17, is designed as thin as possible. For purposes of this disclosure, "thin" refers to a wall thickness of the sleeves 16, 18. The slips 20 and cone pieces 17 remain sufficiently thick, and the majority of the loads held by the slips 20 are directed through the cone pieces 17 and into the mandrel 12, where adequate support is available.

In embodiments, the cone pieces 17 may include an inclined upper surface 38 and an arcuate shaped lower surface 35 which functions as a load pad. The lower surface 35 may be arcuate, complementary in shape to the mandrel 12. The cone piece 17, which may be loaded from an inside of the slip cage 19, may also include retaining means such as feet 34 that extend in an outward direction and prevent the piece 17 from escaping the thru-slot 49 of the slip cage 19.

In some embodiments, a proximal end 36 of the cone piece 17 is received by a pocket 32 located at a respective end 46, 48 of the sleeve 16, 18. When assembled into the pocket 32, the distal end 37 of the cone piece 17 extends past the end 46, 48. The pockets 32 may be equally spaced about the periphery of the sleeve at 120° intervals or another predetermined spacing interval (e.g. 4 pockets at 90° intervals). Each cone piece 17 may include a complementary shaped first end 36 sized to mate with the pocket 32. In some embodiments, the pocket 32 may be a grooved pocket with the first end 36 of the cone piece 17 containing teeth 33 that mate with the grooves. The pocket 32 may be a milled pocket. A small flat head screw is only utilized to hold them down in the grooves 32 when assembled.

The length of the cone piece 17 should be such that it permits a distal end 37 of the piece 17 to flex downward toward the mandrel 12 during setting and contact (and "pinch") the mandrel 12. During release, the distal end 37 should flex upward during release and return to its original state. This flex also helps in assembly. In some embodiments, the length of the cone piece 17 is a length where no portion of the sleeve 16, 18 lies directly below the slips 20 when set.

In embodiments, the circumferentially spaced-apart cone pieces 17 and slips 20 are loaded during assembly from the inside of the housing 16, 18 through a respective longitudinally extending thru-slot or window 49 of the slip cage 19 and captured by the slip cage 19. Slips are often loaded in this way in the prior art, but the prior art cones are always made as a single cylindrical piece. Here, the cone pieces 17 can enter into, and are bounded by, the slip window 49. See e.g. FIGS. 3, 8B, and 10. Socket cap screws that ride along the outside of the housing 16, 18 screw into tapped holes on the back of each cone piece 17 to hold everything in place until the subassembly is slid into position on the anchor 10. The subassembly can be removed in the same manner.

In embodiments, the lower set of cone pieces 17, that is those that extend from sleeve 18, may be connected to the mandrel 12 through the shear release screws 22. Once the desired shear release value is pulled on the anchor 10 in tension, the screws 22 shear and allow the lower set of cone pieces 17 to drop away. The slips 20 can then return back inside of the slip cage 19 for retrieval.

The fully enclosed slips 20 allow for a maximum bypass area 60 around the outside of the anchor 10 while maintaining a full open inside diameter ("ID") through the tubing. In other words, the ID of mandrel 12 is the same as that as the tubing. For example, a reduced OD anchor 10 of this disclosure that is designed for use with a 2⅞" tubing ID can accommodate up to ⅜" lines banded around the tool in the same way that the lines are banded to the tubing. See FIG. 1. This can be done onsite and does not require any special expertise. Because there is area 60 available between all slips 20, multiple lines may be simultaneously routed with no added modifications to the tool 10.

For the extreme case of a ⅝" line, an alternative housing may be used that replaces one row of slips 20 and cones 17 with a carrier 31 for the capillary line. See FIGS. 9 & 9A. The carrier 31 may include a semi-circular portion 51 to receive the line. Teeth 29 may be milled directly in the slip cage 19 and the teeth 29 provide the third point of contact in addition to the two slips 20 that are left intact. The larger line can be loaded onsite just as the smaller lines, and extra area around the slips 20 may be retained to add other lines if desired.

Embodiments of an anchor catcher of this disclosure may include one or more of the following features:

1. an hydraulic setting mechanism;
2. a rotational setting mechanism;
3. a rotational setting mechanism limited to a quarter-turn;
4. a slip unset (run-in) position;
5. a slip set position;
6. a slip cage including at least two slips;
7. a slip cage including at least three slips
8. a slip cage including at least four slips;
9. a setting sleeve arranged coaxial to the slip cage and configured for axial movement relative to the slip cage between a slip unset position and a slip set position;
10. a stationary sleeve arranged coaxial to the slip cage and separated from the setting sleeve by the slip cage;
11. a sleeve, which may be a setting sleeve or a stationary sleeve, including at one end a cone block made up of spaced-apart cone pieces;
12. a cone pieces including spaced-apart cone pieces corresponding to spaced-apart slips;
13. a cone block made up of equally spaced-apart cone pieces;
14. a sleeve including at one end at least two spaced-apart cone pieces;
15. a sleeve including at one end at least three spaced-apart cone pieces;
16. a sleeve including at one end at least four spaced-apart cone pieces;
17. cone pieces configured to engage a respective slip of the slip cage and move the slip between the slip unset and set positions;
18. spaced-apart cone pieces that form a cone block which actuates a set of slips;
19. a cone piece including a proximal end connected to the end of the sleeve;
20. a cone piece including a distal end extending axially away from the opposing end of the sleeve;
21. a cone piece including an upper surface sloping downward from the proximal end toward the distal end;
22. a mandrel, the slip cage and each sleeve surrounding a portion of the mandrel;
23. a cone piece including an arcuate-shaped lower surface complementary in shape to the portion of the mandrel;
24. a distal end of the cone piece flexing downward toward the portion of the mandrel contained by the sleeve as the stationary sleeve moves from the slip unset position to the slip set position.
25. a distal end of the cone piece flexing away from the portion of the mandrel contained by the sleeve as the stationary sleeve moves from the slip set position to the slip unset position;
26. the end of the sleeve containing the cone pieces does not extend below the slip cage when in the slip unset and set positions;
27. one end of each sleeve including a pocket to receive a cone piece;
28. each cone piece including a proximal end shaped complementary to the pocket;
29. the pocket being a grooved pocket;
30. the proximal end of the cone piece including teeth;
31. an external bypass channel;
32. the external bypass channel sized to accommodate a plurality of capillary lines;
33. the slip cage including a line carrier equally spaced from the at least two slips, the line carrier containing an arcuate-shaped slot configured to receive a line;

34. the line carrier including teeth;
35. the cone piece removably connected to the end of the sleeve;
36. each cone piece includes means for retaining the cone piece within an interior space of the slip cage;
37. the means for retaining the cone piece including one or more feet that extend laterally outward from the cone piece.

While embodiments of a tubing anchor catcher of this disclosure have been described, the tool is capable of modification by persons of ordinary skill in the art without departing from the scope of the following claims. The claims include the full range of equivalents to which each recited element is entitled.

What is claimed:

1. A tubing anchor catcher comprising:

a slip cage including at least two slips and corresponding slip windows;

a setting sleeve arranged coaxial to the slip cage and configured for axial movement relative to the slip cage between a slip unset position and a slip set position, the setting sleeve including at one end at least two circumferentially spaced apart cone pieces;

a stationary sleeve arranged coaxial to the slip cage and separated from the setting sleeve by the slip cage, the stationary sleeve including at one end at least two circumferentially spaced apart cone pieces;

each said cone piece being bounded by a respective slip window of the corresponding slip windows and configured to engage a respective slip of the slip cage and move the respective slip between the slip unset and set positions.

2. The tubing anchor catcher of claim 1 further comprising:

each said cone piece including:

a proximal end being a connected end;

a distal end extending axially away from the proximal end; and an upper surface sloping downward from the proximal end toward the distal end.

3. The tubing anchor catcher of claim 1, further comprising:

a mandrel, the slip cage and each sleeve surrounding a portion of the mandrel.

4. The tubing anchor catcher of claim 3, further comprising:

each cone piece including an arcuate-shaped lower surface complementary in shape to the portion of the mandrel.

5. The tubing anchor catcher of claim 3, further comprising:

a distal end of at least one cone piece flexing downward toward the portion of the mandrel when in the slip set position.

6. The tubing anchor catcher of claim 5, further comprising:

the distal end of the at least one cone piece flexing away from the portion of the mandrel from the slip set position to the slip unset position.

7. The tubing anchor catcher of claim 1, wherein the slip cage does not contain the one end of the setting sleeve and the one end of the stationary sleeve when in the slip unset and set positions.

8. The tubing anchor catcher of claim 1, further comprising:

the one end of the setting sleeve and the one end of the stationary sleeve each including a pocket;

a respective cone piece including a proximal end shaped complementary to a respective pocket.

9. The tubing anchor catcher of claim 8, further comprising:

the pocket being a grooved pocket; and the proximal end of the respective cone piece including teeth.

10. The tubing anchor catcher of claim 1, further comprising:

an external bypass channel.

11. The tubing anchor catcher of claim 10, wherein the external bypass channel is sized to accommodate a plurality of lines, at least one line of the plurality selected from the group consisting of a capillary line and an electrical line.

12. The tubing anchor catcher of claim 1, further comprising:

the slip cage including a line carrier equally spaced from the at least two slips, the line carrier containing an arcuate-shaped slot configured to receive a line selected from the group consisting of a capillary line and an electrical line.

13. The tubing anchor catcher of claim 1, wherein at least one cone piece is removably connected to a respective one end of a respective sleeve.

14. The tubing anchor catcher of claim 1, further comprising:

each cone piece including means for retaining the cone piece within an interior space of the slip cage.

15. The tubing anchor catcher of claim 14, further comprising:

the means for retaining the cone piece including a base that extends laterally outward from the cone piece.

16. A tubing anchor catcher comprising:

a slip cage including a set of slips and corresponding slip windows;

a setting sleeve arranged coaxial to the slip cage and configured for axial movement relative to the slip cage between a slip unset position and a slip set position;

a stationary sleeve arranged coaxial to the slip cage and separated from the setting sleeve by the slip cage;

the setting sleeve including at one end a set of circumferentially spaced-apart cone pieces;

the stationary sleeve including at one end a set of circumferentially spaced-apart cone pieces;

each said cone piece bounded by a respective slip window of the corresponding slip windows and configured to engage a respective slip of the set of slips and move the set of slips between the slip unset and set positions.

17. The tubing anchor catcher of claim 16, further comprising:

the one end of the setting sleeve and the one end of the stationary sleeve each including a pocket;

a respective cone piece including a proximal end shaped complementary to a respective pocket.

18. The tubing anchor catcher of claim 16, further comprising:

at least one cone piece of the set of circumferentially spaced-apart cone pieces being a removably attached cone piece.

19. The tubing anchor catcher of claim 16, further comprising:

a distal end of at least one cone piece of the set of circumferentially spaced-apart cone pieces flexing downward when in the slip set position.

20. The tubing anchor catcher of claim 16, further comprising:

at least one external bypass channel.

21. A tubing anchor catcher comprising:

a slip cage including a set of slips;

a setting sleeve arranged coaxial to the slip cage and configured for axial movement relative to the slip cage between a slip unset position and a slip set position, the setting sleeve including at one end a set of circumferentially spaced apart cone pieces and a set of circumferentially spaced apart pockets corresponding to each cone piece of the set of cone pieces;

a stationary sleeve arranged coaxial to the slip cage and separated from the setting sleeve by the slip cage, the stationary sleeve including at one end another set of circumferentially spaced apart cone pieces and another set of circumferentially spaced apart pockets corresponding to each cone piece of the another set of cone pieces;

each said cone piece residing at least in part in a respective pocket and configured to engage a respective slip of the set of slips and move the respective slip between the slip unset and set positions.

22. The tubing anchor catcher of claim 21, further comprising the slip cage including a corresponding set of slip windows, each said cone piece being bounded by a respective slip window of the corresponding slip windows.

23. The tubing anchor catcher of claim 22, at least one of the slips including a line carrier containing an arcuate-shaped slot configured to receive a line selected from the group consisting of a capillary line and an electrical line.

24. The tubing anchor catcher of claim 21, further comprising:

each cone piece including a base that extends laterally outward from the cone piece.

25. A tubing anchor catcher comprising:

a slip cage including a set slips and corresponding slip windows;

at least one sleeve arranged coaxial to the slip cage, the sleeve including a set of circumferentially spaced-apart cone pieces connected to an end of the at least one sleeve;

each said cone piece bounded by a respective slip window of the corresponding slip windows and configured to engage a respective slip of the set of slips and move the respective slip between a slip unset position and a slip set position the end of the at least one sleeve including a set of pockets, a proximal end of each cone piece located in a corresponding pocket of the set of pockets.

26. The tubing anchor catcher of claim 25, the at least one sleeve configured for axial movement relative to the slip cage between the slip unset and slip set positions.

27. The tubing anchor catcher of claim 25, at least one slip of the set of slips including an arcuate-shaped slot configured to receive a capillary line or an electrical line.

28. The tubing anchor catcher of claim 25, each cone piece including a base that extends laterally outward from the cone piece.

* * * * *